United States Patent [19]

D'Autry

[11] 4,128,009

[45] Dec. 5, 1978

[54] ADJUSTABLE DILUTING DEVICE

[76] Inventor: Eric Marteau D'Autry, 69-72 rue Gambetta, 95 Villiers-le-Bel, France

[21] Appl. No.: 823,552

[22] Filed: Aug. 11, 1977

[30] Foreign Application Priority Data

Aug. 18, 1976 [FR] France ..... 76 25081

[51] Int. Cl.[2] ..... B01L 3/02

[52] U.S. Cl. ..... 73/425.6; 222/309

[58] Field of Search ..... 73/425.6, 425.4; 222/309; 23/259

[56] References Cited

U.S. PATENT DOCUMENTS 3,646,817 3/1972 Hinchman et al. ..... 73/425.6

*Primary Examiner*—S. Clement Swisher

*Attorney, Agent, or Firm*—Mason, Kolehmainen, Rathburn & Wyss

[57] ABSTRACT

The present invention relates to an adjustable diluting device, comprising a member for regulating the stroke of a first piston, presenting on its outer surface a thread adapted to cooperate with a thread made on the inner surface of the casing of said device, the lower end of said regulating member acting as stop limiting the upward stroke of the first piston; a tubular adjusting member whose lower end has a stop surface adapted to cooperate with the upper end of a sleeve for controlling the first piston and of which the inner surface is threaded; and a tubular push element fast with a shaft for controlling a second piston having an outer threaded adapted to cooperate with the inner thread of the tubular adjusting member. The invention is more particularly applied to laboratory equipment.

14 Claims, 2 Drawing Figures

ADJUSTABLE DILUTING DEVICE

Figure 1:
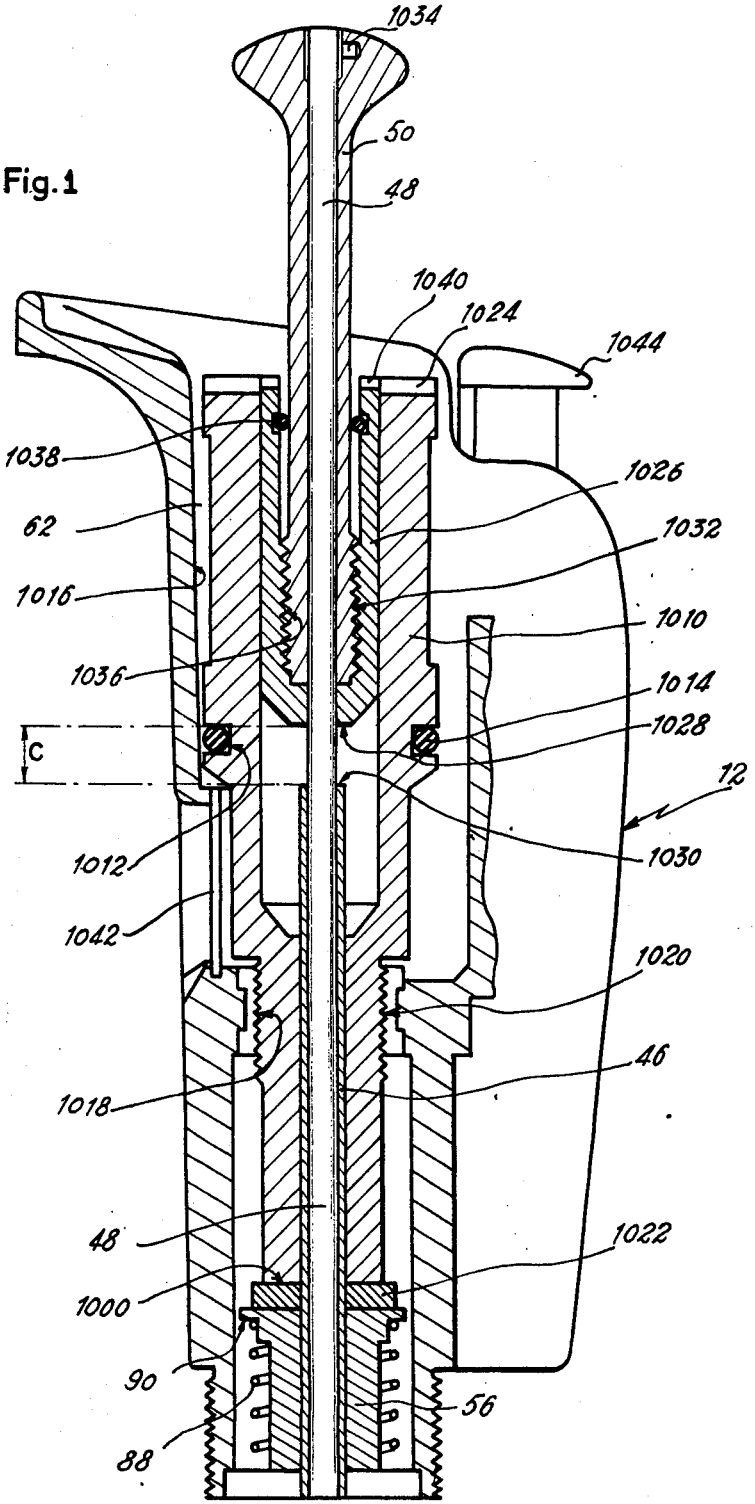

The present invention relates to an adjustable diluting device for mixing a predetermined volume of a liquid sample and a predetermined volume of a liquid diluent.

The diluting device according to the invention makes it possible to draw into the same recipient, rapidly and very precisely, a certain volume of a liquid sample and a certain volume of a liquid diluent, the apparatus according to the invention being adapted, once the mixture produced is at the desired dilution, to transfer it very rapidly into another receptacle.

Using the adjustable diluting device as described in U.S. Ser. No. 792,810, the operator may, by a rapid adjustment, modify for example the volume of the diluent which he proposes to remove and to mix with a certain predetermined volume of the sample. However, in the particular case of certain experiments where the same dilution is always to be made under precise conditions, the diluting device should be frequently readjusted so as to take into account a certain number of corrections, such as for example the correction of temperature. To make very precise dilutions, the adjustable diluting device according to U.S. Ser. No. 792,810 risks not being sufficiently accurate. Furthermore, such an adjustable diluting device is provided with a system of adjustment which is accessible from the outside of the casing of the diluting device. Consequently, this arrangement has the drawback of risking a maladjustment of the system further to a false manoeuvre. It is obvious that if such an incident occurs during manipulation, the whole experiment must be restarted.

Furthermore, in practice, it has proved highly desirable to be able to have an adjustable diluting device whose system of adjustment is entirely integrated in the casing, so that it cannot be actuated directly from the outside of said casing. The system of adjustment must, on the other hand, be actuatable only by certain competent persons capable of carefully readjusting the diluting device for example with the aid of a suitable key or like tool. Due to such an adjustment system, there is no risk of any false manoeuvre when the diluting device is used, since the operator, not having a suitable adjusting tool, cannot modify the adjustment of said device.

The present invention therefore relates to an adjustable diluting device, of the type comprising an oblong casing, internally defining an essentially cylindrical cavity, and a lower tapered tubular element, or nose member, said casing and said nose member being made fast with each other and comprising a plunger unit adapted for reciprocal movement in tight manner inside said casing and said nose member, said plunger unit itself comprising:

a first piston having a central cylindrical recess opening on its lower surface, this first piston being so arranged as to be able to slide in tight manner in said nose member;

a second cylindrical piston of circular cross-section adapted to slide in said central cylindrical recess made in the first piston, with the interposition, between said central cylindrical recess and the second piston, of a sealing ring acting at the same time as frictionally mounted joint;

a sleeve for controlling the first piston, which is fast with said first piston, and which presents on its outer surface an annular shoulder, adapted to cooperate with a stop for limiting the upward stroke of the first piston, and a shaft for controlling the second piston, which is fast with said second piston and which is adapted to slide inside the sleeve controlling the first piston.

In accordance with the present invention, the diluting device further comprises:

a member for regulating the stroke of the first piston, said regulating member being housed in said cavity of the casing, coaxially with respect to said cavity, and having on at least a part of its outer surface a thread adapted to cooperate with a corresponding thread made on the inner surface of said cavity, the lower end of said regulating member acting as stop for limiting the upward stroke of the first piston, whilst the upper part of said regulating member terminates in a sleeve open at its upper end;

a tubular adjusting member adapted to move freely inside the upper part of the regulating member, the lower end of which has a stop surface adapted to cooperate with the free upper end of the sleeve controlling the first piston and of which at least a part of the inner surface is threaded, and a tubular push element made fast with the shaft for controlling the second piston, the upper part of which terminates in an enlargement and the lower end of which is provided with an outer thread adapted to copperate with said inner thread made on the inner surface of the tubular adjusting member, a frictionally mounted joint being interposed between said tubular push element and the inner surface of the tubular adjusting member.

According to a further feature of the present invention, the upper end of said regulating member and/or said tubular adjusting member is provided with a ring intended to allow said member to rotate.

According to another feature of the present invention, said ring is located inside the cavity of the casing so as not to be directly accessible from outside the diluting device.

Figure 2:
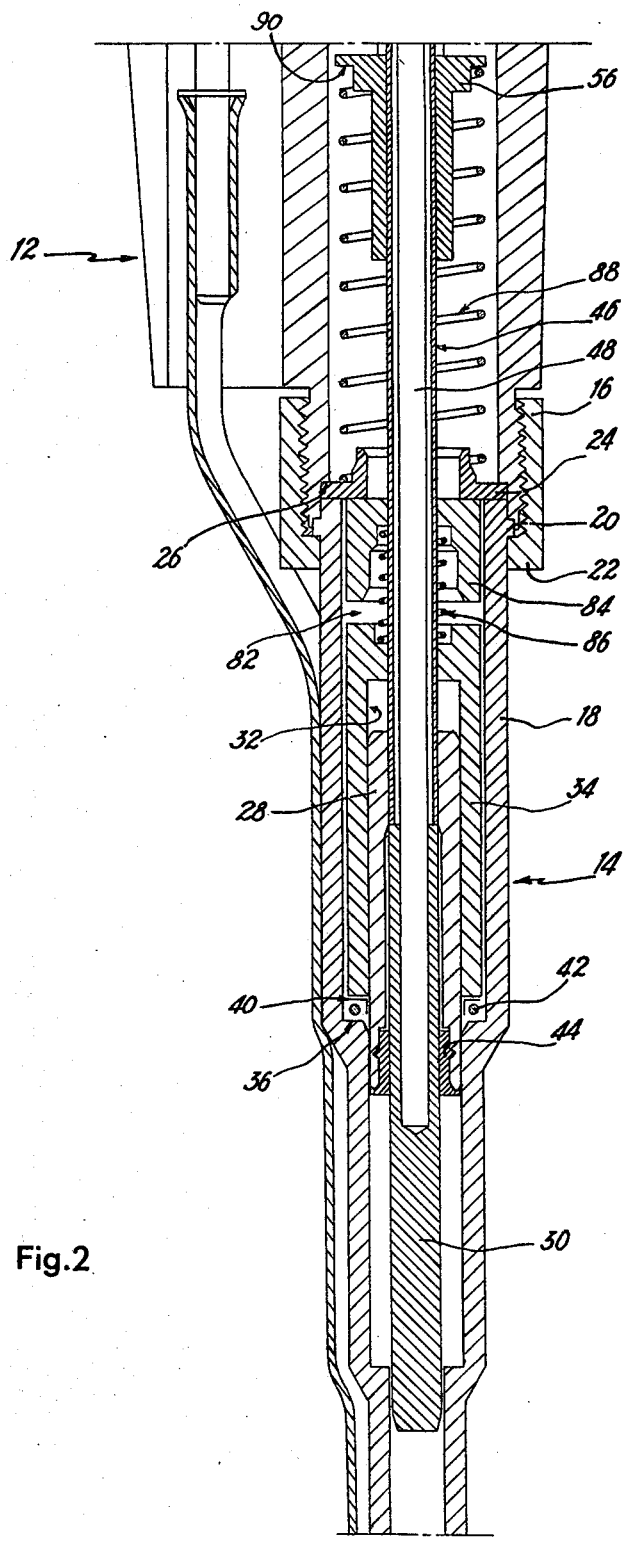

The invention will be more readily understood on reading the following description with reference to the accompanying drawings, in which:

FIG. 1 shows a section through the upper part of the diluting device according to the invention, and FIG. 2 shows a section of the lower part of the diluting device according to the invention.

Referring now to the drawings, FIG. 1 shows the diluting device according to the present invention, which comprises an oblong casing 12 and a lower tapered tubular element or nose member 14. Said casing 12 and said nose member are securely connected to each other.

The nose member 14 comprises an enlarged upper part 18 internally defining a chamber. An annular assembly rib 20 is firmly held against the lower end of the casing 12 by a face 22 of a nut 16, and a centering washer 24 is imprisoned between the rear end of the nose member 14 and a shoulder 26 defined by a counterbore at the front end of the cylindrical part of the casing 12.

A plunger unit is adapted to move inside the casing 12 and inside the nose member 14. This plunger unit comprises a first piston 28 and a second cylindrical piston 30 of circular cross-section. The first piston 28 presents a central cylindrical recess 32 opening on its lower surface. This first piston 28 is arranged so as to be able to slide in tight manner inside the nose member 14. This seal may for example be obtained by the interposition, between the outer surface of the first piston 28 and the inner surface of the enlarged upper part 18 of the nose member 14, of a seal seat 34 which is elastically urged downwardly in the direction of the annular shoulder 36. Between the lower surface of the seal seat 34 and the annular shoulder are respectively interposed a Teflon seal 40 and an O-ring 42.

The second cylindrical piston 30 of circular cross-section is adapted to slide in the central cylindrical recess 32 made in the first piston 30. Between the outer surface of the second piston 30 and the inner surface of the first piston 28, near the lower end of said latter, there is interposed a frictionally mounted joint. This joint may advantageously be in the form of a Teflon O-ring 44 made fast, by any known means, with the first piston 28. This frictionally mounted joint acts in fact as a brake and enables the second piston 30 to be immobilised in the position chosen with respect to the first piston 28.

The first piston 28 has been securely connected to a control sleeve 46. To this end, the first piston 28 is pressfitted for example on the control sleeve 46.

A shaft 48 for controlling the second piston 30 is adapted to slide inside the sleeve 46 for controlling the first piston 28. This control shaft 48 is rigidly fixed at the upper end of the second piston 30.

At the upper end of said shaft 48 is located a tubular push element 50 made fast with the shaft 49 controlling the second piston. The upper part of this tubular push element 50 terminates in an enlargement acting as push button.

The rigid assembly constituted by the first piston 28 and by its control sleeve 46 is permanently urged elastically upwardly. To this end, the control sleeve 46 presents on its outer surface a shoulder adapted to cooperate with a stop limiting the upward stroke of the first piston 28, which stop is adjustable in vertical position with respect to the casing 12 by means of an adjustment mechanism described hereinafter in greater detail. In the embodiment shown, said shoulder arranged on the outer surface of the control sleeve 46 is made in the form of an inner cylindrical stop 56 press-fitted on the sleeve 46 or fixed by any other means so that it is integral with the sleeve 46. This member 56 is therefore permanently urged upwardly so as to come into intimate contact with the lower end of the stop limiting the stroke of the first piston. This stop which is variable in vertical position is constituted by the lower end 1000 of a member 1010 for regulating the stroke of the first piston. This regulating member 1010 is housed in the cavity 62 of the casing 12, coaxially with respect to said cavity. Said regulating member 1010 is provided on its outer surface with a groove 1012 adapted to receive a braking ring 1014 compressed between the inner surface 1016 of the casing 12 and said groove 1012. The function of this braking ring 1014 is to immobilise the regulating member 1010 in rotation in its position chosen by the person having proceeded with adjusting the diluting device.

Said regulating member 1010 is provided on at least a part of its outer surface with a thread 1018 adapted to cooperate with a corresponding thread 1020 made on the inner surface of said cavity 62. When a rotary movement is imparted to said regulating member 1010, said latter is therefore displaced slightly upwardly or downwardly with respect to the casing 12. The lower end 1000 of said regulating member 1010 acts as stop limiting the upward stroke of the first piston. The lower stop surface 1000 of the regulating member 1010 may enter into direct contact with the upper surface of the inner cylindrical stop 56 or it may be provided to interpose, between these two stop surfaces, a cross-piece 1022 having a predetermined thickness. The nominal volume intended to be taken by the first piston may thus be determined by the choice of the thickness of said cross-piece. It is thus readily understood that by varying the thickness of this cross-piece 1022, the useful stroke of the first piston and therefore the nominal volume taken by said first piston will consequently be modified.

The upper part of said regulating member 1010 terminates in a sleeve open at its upper end. The upper end of said sleeve, adapted to be animated by a movement of rotation about its axis, has a particular relief 1024, for example a plurality of grooves adapted to cooperate with a corresponding adjusting key or any other suitable tool. In the embodiment illustrated, the sleeve terminates in a ring inside the cavity 62 of the casing 12. This ring is therefore not accessible directly from outside said casing.

The diluting device according to the invention further comprises a tubular adjusting member 1026 adapted to move freely inside the upper part of the regulating member 1010. The lower end of the tubular adjusting member 1026 has a stop surface 1028 adapted to cooperate with the upper free end 1030 of the sleeve 46 for controlling the first piston. At least a part of the inner surface of the tubular adjusting member 1026 has an internal thread 1032.

The tubular push element 50 made fast with the shaft 48 controlling the second piston, for example by the presence of a counter-nut 1034, has a lower end which is provided with an outer thread 1036 adapted to cooperate with said inner thread 1032 made on the outer surface of the tubular adjusting member 1026. Between said tubular push element 50 and the inner surface of the tubular adjusting member 1026 is interposed a frictionally mounted joint. This joint may for example be in the form of a braking ring 1038 mounted in the compressed state between the outer surface of the push element 50 and the inner surface of the tubular adjusting member 1026. The braking rings 1014 and 1038 used must be made of supple, elastically deformable material, resisting wear and tear. Such a braking ring may for example be made of a fluorocarbon resin, polychloroprene or preferably of an elastomeric polyurethane. In practice, straight-chain polyurethanes have proved particularly satisfactory.

Said tubular adjusting member 1026 terminates at its upper end in a ring intended to allow the rotation of said member. Like the preceding ring, this one is located inside the cavity of the casing 62 so as not to be directly accessible from outside the diluting device. This ring also has a suitable relief 1040 which is for example constituted by a set of grooves, and which is adapted to cooperate with a corresponding adjusting member such as an adjusting key.

The outer surface of the member 1010 for regulating the stroke of the first piston has a graduation representative of the position of said member 1010 inside the cavity 62 made in the casing 12 of the diluting device. This graduation, where therefore exactly translates the value of the volume taken by the first piston, is visible through a window 1042 made in said casing 12 of the siluting device opposite said graduation.

To obtain a reading of the volume taken by the second piston, the tubular push element 50 comprises on its outer surface a micrometric mark enabling the position of said tubular push element 50 to be accurately located when it is at rest, in outwardly drawn position, this therefore accurately translating the volume of liquid taken by the second piston.

The upper part 18 of the nose member 14 internally defines an elastic stop chamber 82 inside which an elastic stop 84 is adapted to move against an upwardly directed elastic force exerted by an elastic stop spring 86. The plunger unit is elastically urged upwardly by means of a return spring 88 mounted between the shoulder 90 of the inner cylindrical stop 56 and the upper part of a centering washer 24. The return spring 88, elastically urging the sleeve 46 controlling the first piston upwardly, is endowed with a resistance at least substantially weaker than that of said elastic stop spring 86. This arrangement makes it possible to obtain a supplementary downward stroke of the plunger unit, this providing, during ejection, a supplementary stroke with respect to the suction stroke. This feature therefore makes certain that all the liquid taken is ejected.

To avoid contamination of the sample and diluent liquids taken, due to remains of previously sampled liquid, a removable, disposable, conical tip member is provided to be frictionally mounted on outer surface of the free lower end of the nose member. The inner volume of the removable tip member is selected to be sufficient to contain all the mixture made, without there being any contact with the lower end of the nose member. This tip member is preferably made of a non-wetting plastic material to facilitate complete discharge of the samples.

According to an advantageous embodiment of the present invention, the adjustable diluting device may be equipped with a device for automatically ejecting the removable tip members. This device will not be described in greater detail, since it has already formed the subject matter of U.S. Pat. No. 3,991,617 filed by Applicant. This device for automatically ejecting removable tip members is actuated by means of a push button 1044 located in the immediate vicinity of the upper enlargement of the tubular push element 50.

The functioning of the adjustable diluting device according to the invention will be explained hereinafter in the particular case of it being desired to mix a volume of liquid sample of 50μl with a volume of 500μl of liquid diluent.

A diluting device should firstly be used, of which the cross-piece 1022 for adjusting the volume of the diluent will be chosen to be of such a thickness as to correspond to a nominal volume of 500μl. The exact position of the member 1010 regulating the upward stroke of the first piston should then be adjusted by means of the adjusting key or tool. Once this adjustment is made, the mark indicated on the outer surface of said regulating member 1010 may be read through window 1042. This mark may be noted precisely with a view to being able to reproduce, later, exactly the same adjustment of the volume of diluent to be taken.

The volume of liquid sample to be taken is then adjusted. To this end, an adjusting key or tool is used, intended to cooperate with the ring made in the upper part of the tubular adjusting member 1026. By imparting a rotation to this tubular adjusting member 1026, this member is therefore moved with respect to the tubular push element 50 which always remains fast with the control shaft 48. This is translated by an upward or downward displacement of the lower stop surface 1028 of the tubular adjusting member 1026, which is adapted to cooperate with the free upper end 1030 of the sleeve 46 controlling the first piston. The second adjustment will be translated by a greater or lesser extension of the tubular push element in its high position, which position may be very exactly located by the presence of a micrometric mark on the outer surface of the tubular push element 50. In FIG. 1, the stroke C is representative of the stroke of the second cylindrical piston inside the central cylindrical recess made in the first piston, this stroke therefore corresponding to the taking of the sample.

To make the dilution proper, the stop surface 1028 of the tubular adjusting member 1026 is brought in contact with the free upper end 1030 of the sleeve 46 controlling the first piston, this operation being effected due to a slight pressure exerted on the upper part of said tubular push element 50 against the resisting force exerted by a frictionally mounted joint disposed between the two pistons.

A greater pressure is then exerted on the tubular push element 50, so as to displace the two pistons and the two control members 46 and 48 downwardly. This downward movement is allowed by the compression of return spring 88.

The tip member is then immersed in the liquid diluent and the tubular push element 50 is released. The plunger unit then returns, under the action of the return force exerted by spring 88, into the preceding position. The first piston therefore rises in the inner cavity made in the nose member and it creates a depression transmitted to the inside of the removable tip member. This depression thus allows the 500μl of diluent to be taken in said tip member.

The outer surface of the removable tip member is then wiped for example with a filter paper, then it is introduced into the liquid sample.

An upward force is then exerted on the tubular push element 50 so as to cause the shaft 48 to rise in sleeve 46, this being translated by a rise of the second piston inside the cylindrical cavity made in the first piston. In this way, a second depression is created which is communicated to the inside of the removable tip member and is translated by the taking of the 50μl of sample. This latter position of the plunger unit is illustrated in FIG. 1.

The desired dilution has thus been made and it remains only to exert a downward pressure on the tubular push element 50 to discharge this mixture into a flask. Due to the presence of the elastic stop chamber, the first and second pistons move in the cavity made in the nose member by a greater stroke than that which would correspond to the suction stroke.

One is thus assured that all the mixture taken is completely delivered from the removable tip member.

What is claimed is:

1. An adjustable diluting device intended for mixing a predetermined volume of a liquid sample and a predetermined volume of a liquid diluent, of the type comprising an oblong casing, internally defining an essentially cylindrical cavity, and a lower tapered tubular element, or nose member, said casing and said nose member being made fast with each other, and comprising a plunger unit adapted for reciprocal movement in tight manner inside said casing and said nose member, said plunger unit itself comprising:

a first piston having a central cylindrical recess opening on its lower surface, this first piston being so arranged as to slide in tight manner inside said nose member, a second cylindrical piston of circular cross-section adapted to slide in said central cylindrical recess made in the first piston, with the interposition, between said central cylindrical recess and the second piston, of a sealing ring acting at the same time as frictionally mounted joint;

a sleeve for controlling the first piston, which is fast with said first piston, and which presents on its outer surface an annular shoulder adapted to cooperate with a stop for limiting the upward stroke of the first piston, and a shaft for controlling the second piston, which is fast with said second piston and which is adapted to slide inside the sleeve for controlling the first piston, said diluting device further comprising:

a member for regulating the stroke of the first piston, said regulating member being housed in said cavity of the casing, coaxially with respect to said cavity, and having on at least a part of its outer surface a thread adapted to cooperate with a corresponding thread made on the inner surface of said cavity, the lower end of said regulating member acting as stop for limiting the upward stroke of the first piston, whilst the upper part of said regulating member terminates in a sleeve open at its upper end;

a tubular adjusting member adapted to move freely inside the upper part of the regulating member, the lower end of which has a stop surface adapted to cooperate with the free upper end of the sleeve for controlling the first piston and of which at least a part of the inner surface is threaded, and, a tubular push element made fast with the shaft for controlling the second piston, the lower end of which is provided with an outer thread adapted to cooperate with said inner thread made on the inner surface of the tubular adjusting member, a frictionally mounted joint being interposed between said tubular push element and the inner surface of the tubular adjusting member.

2. The adjustable diluting device of claim 1, wherein the upper end of said regulating member and/or said tubular adjusting member is provided with a ring intended to allow said member to rotate.

3. The adjustable diluting device of claim 2, wherein said ring is located inside the cavity of the casing so as not to be directly accessible from outside the diluting device.

4. The adjustable diluting device of claim 2, wherein the ring has an appropriate relief, such as a set of grooves, adapted to cooperate with a corresponding member such as an adjusting key.

5. The adjustable diluting device of claim 1, wherein the outer surface of the regulating member has a mark representative of the position of said member inside the cavity made in the casing of the diluting device, said mark being visible through a window made in said casing opposite said mark.

6. The adjustable diluting device of claim 1, wherein the tubular push element comprises on its outer surface a micrometric mark enabling the volume of liquid taken by the second piston to be accurately marked.

7. The adjustable diluting device of claim 1, wherein, between the upper surface of the annular shoulder made on said control sleeve and the lower stop surface of the regulating member, there is interposed an interchangeable cross-piece of predetermined thickness, the nominal volume intended to be taken by the first piston thus being determined by the choice of the thickness of said cross-piece.

8. The adjustable diluting device of claim 1, further comprising an elastic stop chamber arranged in the upper part of the nose member, as well as an elastic stop adapted to move inside said chamber against an upwardly directed elastic return force exerted by an elastic stop spring.

9. The adjustable diluting device of claim 8, wherein the sleeve for controlling the first piston is elastically urged upwardly by means of a return spring having a resistance at least substantially weaker than that of the elastic stop spring.

10. The adjustable diluting device of claim 1, wherein the outer surface of the regulating member presents a groove adapted to receive a braking ring compressed between the inner surface of the casing and said groove with a view to locking said regulating member in rotation.

11. The adjustable diluting device of claim 1, wherein a braking ring is mounted in the compressed state between the outer surface of the push element and the inner surface of the tubular adjusting member, in a non-threaded zone.

12. The adjustable diluting device of claim 10, wherein said braking ring is made of a supple, elastically deformable material, resisting wear and tear, such as for example a fluorocarbon resin, polychloroprene or preferably polyurethanes.

13. The adjustable diluting device of claim 1, wherein the free end of the nose member is fitted with a removable, disposable conical tip member frictionally mounted on the outer surface of said end.

14. The adjustable diluting device of claim 13, wherein it is equipped with a device for ejecting the removable tip member, which may be actuated by means of a push button located near the upper end of the tubular push element.

* * * * *